United States Patent [19]

Bardenstein

[11] 4,356,948

[45] Nov. 2, 1982

[54] TRUSS ASSEMBLY UNIT

[75] Inventor: Albert Bardenstein, Syracuse, N.Y.

[73] Assignee: Irwin J. Berlin

[21] Appl. No.: 171,978

[22] Filed: Jul. 24, 1980

[51] Int. Cl.[3] ..... B27F 7/02

[52] U.S. Cl. ..... 227/48; 100/913; 227/113; 227/152

[58] Field of Search ..... 227/39, 48, 50, 110, 227/113, 152; 100/913; 29/432, 787, 798

[56] References Cited

U.S. PATENT DOCUMENTS

| | | | |
|---|---|---|---|
| 3,068,483 | 12/1962 | Moehlenpah et al. | 227/152 |
| 3,207,406 | 9/1965 | Bowman | 100/913 |
| 3,238,867 | 3/1966 | Jureit et al. | 100/913 |
| 3,243,177 | 3/1966 | Christman et al. | 100/913 |
| 3,358,348 | 12/1967 | McGlinchey | 100/913 |
| 3,713,381 | 1/1973 | Mort et al. | 100/913 |
| 3,728,958 | 4/1973 | Moehlenpah et al. | 100/913 |
| 3,837,274 | 9/1974 | Zaccaro | 227/152 |
| 3,908,885 | 9/1975 | Scott | 227/152 |

*Primary Examiner*—John McQuade

*Attorney, Agent, or Firm*—Kane, Dalsimer, Kane, Sullivan and Kurucz

[57] ABSTRACT

An apparatus is disclosed for forming building trusses. The apparatus includes a clamp for each section of lumber of the truss along with a plate press mechanism for each joint of the truss. The press mechanism serves to press nails through joint plates on opposite sides of each truss joint.

7 Claims, 6 Drawing Figures

TRUSS ASSEMBLY UNIT

BACKGROUND OF THE INVENTION

The present invention relates to mechanized construction equipment and in particular to a device for the automated assembly of truss units.

The conventional lumber building truss comprises a horizontal member to which vertical and diagonal members are secured through metal connector plates. As shown in FIG. 1, a typical truss 10 includes a bottom chord 12, top chords 14, center post 16, vertical webs 18 and diagonal webs 20. Although the members are sometimes nailed directly to each other for small spans, the members for larger trusses are joined through steel plates 22 positioned on both sides of the truss at each joint. Nails are passed (through holes in the plates) into each of the members at the joints thereby securely fixing the members together.

In conventional building construction, the trusses are assembled at the construction site. This requires skilled carpenters who must work under adverse field conditions handling lumber and using hand tools.

It is the principle object of the present invention to provide an automated device for the assembly of construction trusses at a cost substantially less than that for comparable trusses built by conventional techniques.

A further object is to provide such a device capable of building a plurality of such trusses without requiring any handling of material.

A still further object is to provide such a device which may be operated by relatively unskilled workers.

SUMMARY OF THE INVENTION

The above and other objects and advantages are attained in accordance with the present invention by providing a mechanized truss forming machine which includes clamps for holding the truss lumber in position to form a truss while the joining plates are secured. The plates are secured by means of press plates at each joint which press the securing nails in position from both sides. Each of the press plates is movable toward and away from the truss joints it forms to facilitate loading of lumber into position and the removal of the completed truss.

The clamps form a portion of a lumber loading mechanism which guides lumber to be held in the truss array. A plurality of press plates are provided, one for each of the joints to be formed. Similarly, a plurality of loading mechanisms must be provided, one for each piece of lumber of the truss configuration.

DETAILED DESCRIPTION OF THE PREFERRED EMBODIMENT

Figure 1:
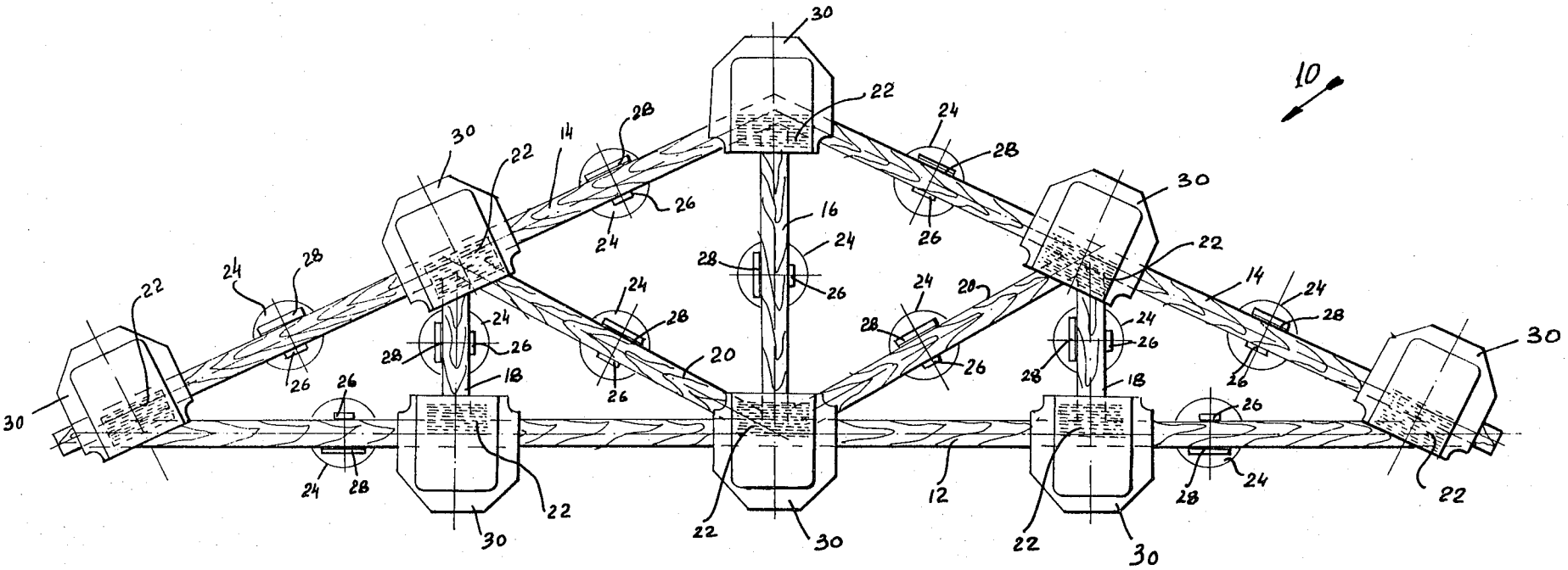
FIG. 1 is a simplified plan view depicting a truss to be assembled utilizing the device of the present invention and schematically depicting the location of the press plates and lumber clamps.

Reference is now made to the drawings and to FIG. 1 in particular wherein the previously described truss 10 is shown being formed on a mechanism in accordance with the present invention. To this end, for each section of lumber there is shown a lumber feed mechanism, generally designated by the numeral 24 which terminates in a pair of clamps 26, 28 for each section of lumber of the truss. Similarly, for each joint where two or more sections of lumber meet, a press mechanism 30 is provided.

Figure 3:
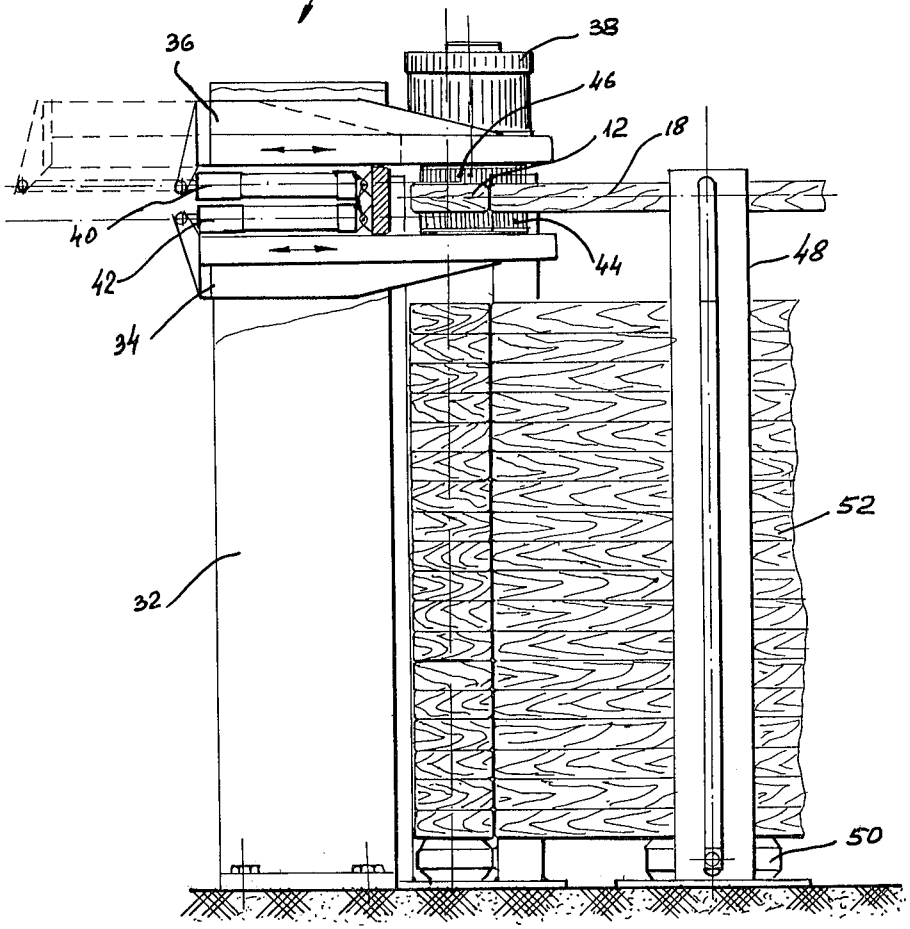
FIG. 3 is a side elevational view of the mechanism of FIG. 2.
Figure 2:
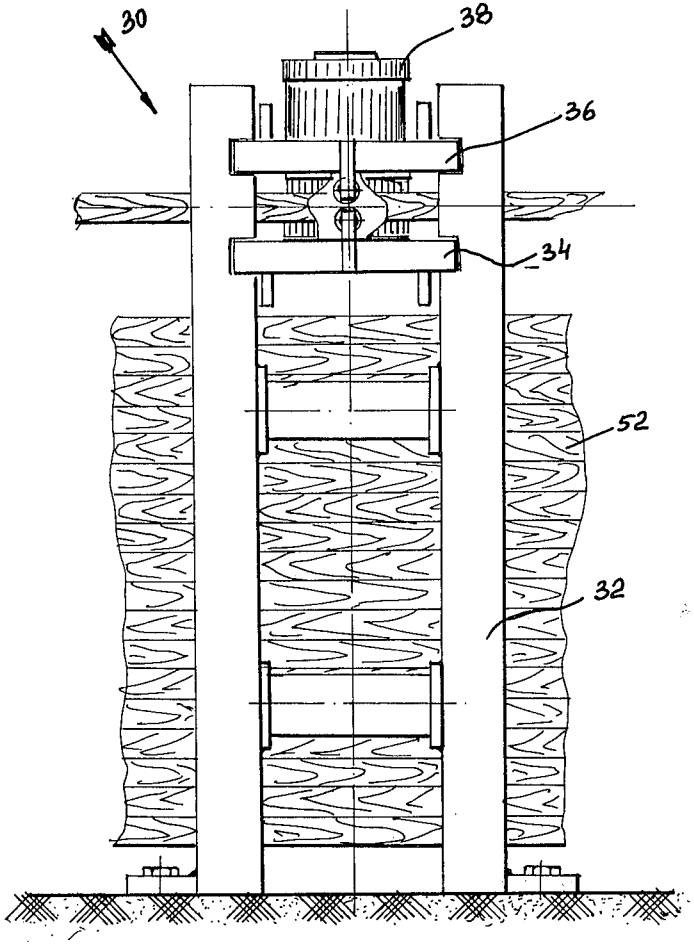
FIG. 2 is a front elevational view of a plate securing mechanism.

Reference is now made to FIGS. 2 and 3 wherein details of the press mechanism 30 are shown. To this end, each press unit consists of a support stand formed from uprights 32. A pair of spaced press plates 34 and 36 are provided in grooves at the upper end of the uprights. The grooves permit horizontal movement of the plates toward and away from the joint. The upper plate 36 has secured to it a hydraulic cylinder 38 which drives the plates vertically. The bottom plate 34 provides the counterforce for the top plate 36. Horizontal movement of the plates 34 and 36 is controlled by independent cylinders 40 and 42. When sections of lumber (such as sections 12 and 18) are held by their associated clamps 24 in proper position for joining, nail plates 44 and 46 are positioned at the bottom and top of the joint, as will be described, the plates are activated and nails within the plate are driven into the lumber at the joint.

Pre-cut lumber for the trusses are stacked in guides, one for each section of the truss, which guides are generally designated by the numeral 48. At the bottom of each lumber stack 52 is a vertical pusher 50. Initially the upper plate is held in position while the lower plate is retracted through its cylinder 42. The lumber stack 52 is then lifted by pusher 50 until the upper most piece of lumber abuts the upper plate 36. The lumber is then held by the clamp mechanism 24 as will be described. The pusher 50 is then withdrawn permitting the remainder of the lumber stack to drop. The bottom plate 34 is then extended beneath the top plate 36. Cylinder 38 is then activated driving the plates toward each other thereby pressing nails in plates 44 and 46 into the lumber of the joint. When the joint is completed the top plate is withdrawn through cylinder 40 thereby permitting the truss to be removed.

The nail plates 44 and 46 are secured to the plates 34 and 36 when the plates are in their withdrawn position. This may readily be done by providing all or a portion of the plates as magnetic members sufficiently strong to hold the steel plates 44 and 46. The nails for the plates are prepositioned as shown in openings in the plates.

Figure 6:
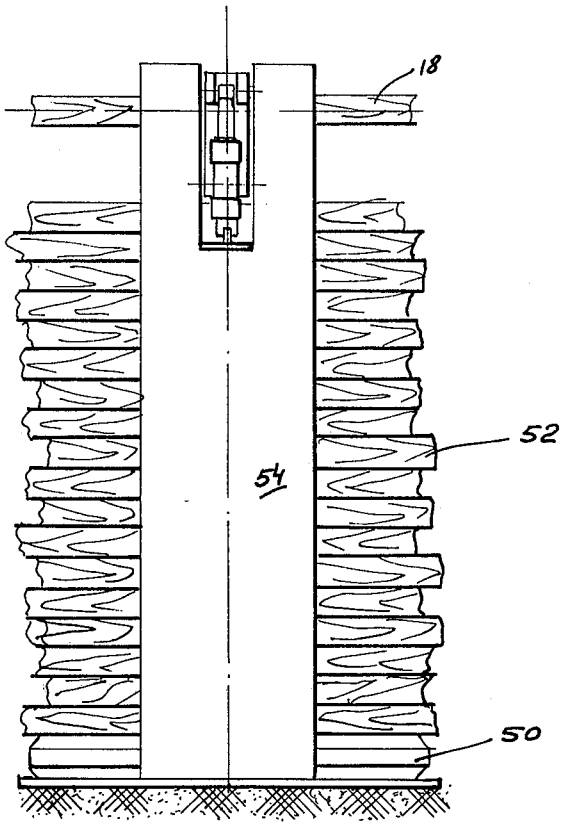
FIG. 6 is a front elevational view of the mechanism of FIG. 4.
Figure 5:
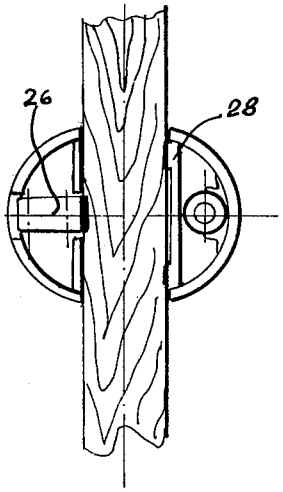
FIG. 5 is a fragmentary plan view of the lumber clamp mechanism.
Figure 4:
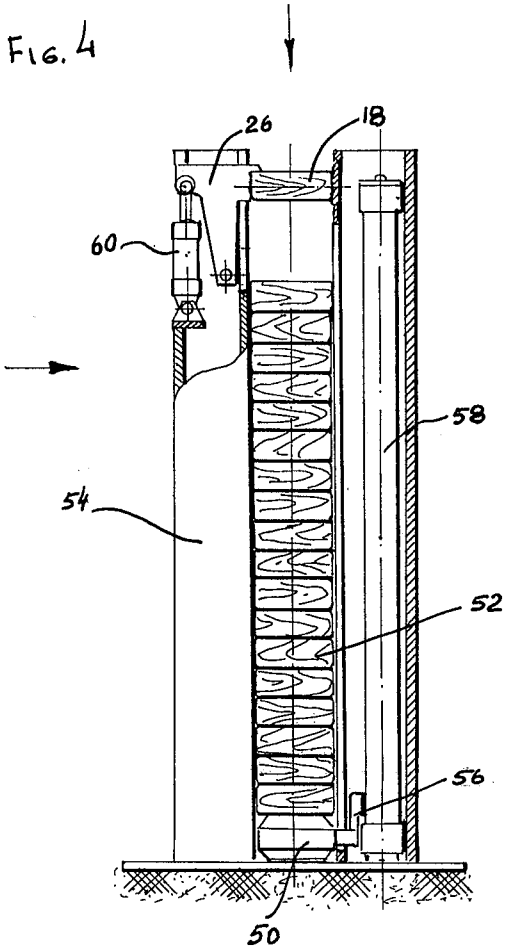
FIG. 4 is an end elevational view of the lumber clamping mechanism and associated lumber feed.

Details of the clamping mechanism are shown in FIGS. 4 through 6. A pair of vertical guides 54 stands along each stack of lumber 52 with pusher 50 extending between the guides. The pusher is connected through joint 56 to the piston of a pneumatic cylinder 58. When air is applied to pusher 50 to lift the lumber stack as previously described, it also operates a cylinder 60 which trips clamp 26 permitting the uppermost piece of lumber 18 to fit between clamps 26 and 28. When the pusher cylinder is released cylinder 60 is activated to drive the clamps 26 and 28 toward each other thereby capturing lumber length 18 between them.

As stated a clamp mechanism 24 and press mechanism 30 must be provided for each section of lumber and joint of the truss. It should be apparent that all the mechanisms can be simultaneously trigger or the truss may be built up.

Thus, in accordance with the above, the aforementioned objects are attained.

Having thus described the invention, what is claimed is:

1. An apparatus for forming a truss having at least one joint defined by the intersection of at least two sections of lumber, said joint being formed by a pair of opposed plates each of which is nailed to each of said lumber sections, said apparatus comprising:

means for holding each of said sections of lumber in position to form said joint; said holding means including a pair of spaced apart clamp members positioned at the top of vertical support members, means for securing a stack of lumber between said support members, and means for lifting said stack toward said clamp members;

means for positioning said plates on opposite sides of said joint; and, means for pressing nails prepositioned in said plates into said sections.

2. The apparatus in accordance with claim 1 wherein said nail pressing means includes means thereon for securing said plates thereto.

3. The apparatus in accordance with claim 2 wherein said plates are formed of a ferrous material and at least portions of said pressing means are magnetic.

4. The apparatus in accordance with claim 1 further including means for urging said clamp members toward and away from each other, said urging means operatively controlled by said lifting means.

5. The apparatus in accordance with claim 1 wherein said pressing means includes a pair of vertically spaced plates positioned above said stack of lumber and means for urging said plates toward each other.

6. The apparatus in accordance with claim 5 wherein each of said plates is movable horizontal into and out of line with said lumber stack.

7. The apparatus in accordance with claim 1 wherein each section of said truss is provided with said holding means and each joint of said truss is provided with said pressing means.

* * * * *